United States Patent [19]

Kanai et al.

[11] 4,415,411

[45] Nov. 15, 1983

[54] ANODE COATED WITH β-LEAD DIOXIDE AND METHOD OF PRODUCING SAME

[75] Inventors: Hideo Kanai; Akihiro Shinagawa, both of Maebashi; Takahiro Yamazaki, Shibukawa; Reiichi Itai, Maebashi, all of Japan

[73] Assignee: The Japan Carlit Co., Ltd., Tokyo, Japan

[21] Appl. No.: 236,908

[22] Filed: Feb. 23, 1981

[30] Foreign Application Priority Data

Mar. 4, 1980 [JP] Japan ..... 55-26182

[51] Int. Cl.[3] ..... C25B 11/16

[52] U.S. Cl. ..... 204/29; 204/32 R; 204/38 B; 204/57; 204/286; 204/290 F

[58] Field of Search ..... 204/29, 32 R, 38 B, 204/57, 288, 289, 290 F, 290 K, 286; 429/242

[56] References Cited

U.S. PATENT DOCUMENTS

| | | | |
|---|---|---|---|
| 2,872,405 | 2/1959 | Miller et al. | 204/290 |
| 3,180,761 | 4/1965 | Horn et al. | 429/242 |
| 3,207,679 | 9/1965 | Schmidt | 204/42 |
| 3,953,316 | 4/1976 | Baker | 204/288 |
| 4,236,978 | 12/1980 | Prengaman et al. | 204/57 |

FOREIGN PATENT DOCUMENTS

| | | | |
|---|---|---|---|
| 40-17445 | 8/1940 | Japan | 204/290 |

*Primary Examiner*—Howard S. Williams
*Assistant Examiner*—William Leader
*Attorney, Agent, or Firm*—Frishauf, Holtz, Goodman & Woodward

[57] ABSTRACT

An anode coated with β-lead dioxide which comprises a titanium substrate, titanium expanded metal welded on at least one side of the titanium substrate, titanium reinforcing bars welded on the peripheries of said expanded metal to both said expanded metal and said substrate, at least one intermediate layer being applied on said substrate and said expanded metal, said intermediate layer consisting either of an alloy or an oxide of platinum group metals; and a β-lead dioxide coating layer on said intermediate layer.

The anode of this invention has particularly good dimensional stability and provides excellent adhesion of the β-lead dioxide coating layer to the substrate, and hence is highly suitable for the electrolytic production of chlorates, perchlorates, and periodates, and furthermore it is also useful as an insoluble anode in electroplating and in electrolytic treatment of waste water.

13 Claims, 3 Drawing Figures

ANODE COATED WITH β-LEAD DIOXIDE AND METHOD OF PRODUCING SAME

BACKGROUND OF THE INVENTION

1. Field of the Invention

This invention relates to an anode coated with β-lead dioxide which has dimensional stability and excellent adhesion between the β-lead dioxide coating layer and a titanium substrate. More particularly, this invention relates to an anode coated with β-lead dioxide which comprises a titanium substrate on at least one side of which both titanium expanded metal and titanium reinforcing bars are welded, at least one medium layer (i.e., intermediate layer) being applied on said substrate, said intermediate layer consisting either of an alloy or an oxide of platinum group metals, and a β-lead dioxide coating layer being applied on the said intermediate layer.

2. Description of the Prior Art

An anode for use in electrolytic industries should have not only excellent anodic characteristics and corrosion resistance, but also excellent workability, mechanical strength and dimensional stability. Recently, the use of coated metallic anodes in the chlor-alkali industry has been proposed. Such coated metallic anodes have excellent anodic characteristics, corrosion resistance, and dimensional stability and have brought about a number of remarkable improvements in the chlor-alkali industry. However, these anodes have disadvantages in that they are expensive and have relatively short life when they are used under oxygen generation.

On the other hand, the β-lead dioxide anode has been known from old times, and has been recognized to have high oxygen overvoltage characteristics, high corrosion resistance, peculiar catalytic properties and economic advantages resulting from its low manufacturing cost. However, the β-lead dioxide anode has not been adapted very widely in the electrolytic industy in spite of its excellent characteristics. This is due mainly to its lack of mechanical strength, dimensional stability, and workability. Planar β-lead dioxide anodes have conventionally been manufactured by anodically electrodepositing β-lead dioxide on a concave surface of a substrate from a lead nitrate bath, and then by detaching β-lead dioxide layer from the substrate. Such anodes are not free from strong internal stresses and hence are very brittle, thus limiting the size and shape that can be manufactured and substantially reducing their practical value in industry. The attempt has been made to electrodeposit β-lead dioxide on a graphite or on a flash coated platinum which is coated on titanium substrate (See U.S. Pat. No. 3,207,679). This was not very successful, however, because β-lead dioxide is apt to detach from the substrate because of low adhesion and the growth of cracks, and such anodes were too heavy for easy handling. More recently, the manufacture of a β-lead dioxide anode by electrodepositing β-lead dioxide on a screen was tried (See U.S. Pat. No. 2,872,405). The adhesion of the coating layer to the anode was better, but it was difficult to obtain even plates. Thus, the surface was uneven, the dimensional stability was insufficient, and it was impossible to obtain even anodes of the substantial dimensions required in industry. In addition, difficulty was encountered in applying a current connection to the anode.

Accordingly, an anode coated with β-lead dioxide is not satisfactory for extended use in the electrolytic industries, mainly because of the lack of mechanical strength, and dimensional stability and the difficulty of manufacturing large anodes.

SUMMARY OF THE INVENTION

An essential object of this invention is to obtain an anode coated with β-lead dioxide of industrially advantageous performance.

Another object of this invention is to obtain an anode coated with β-lead dioxide which has dimensional stability and strong adhesion between a titanium substrate and β-lead dioxide coating layer.

Still another object of this invention is to obtain an anode which has practically no limits on shape and size.

These and further objects and advantages of the present invention will become apparent by the description hereunder.

BRIEF DESCRIPTION OF THE DRAWING

This invention is further described with reference to the accompanying drawings.

DETAILED DESCRIPTION OF THE PREFERRED EMBODIMENT

Figure 1:
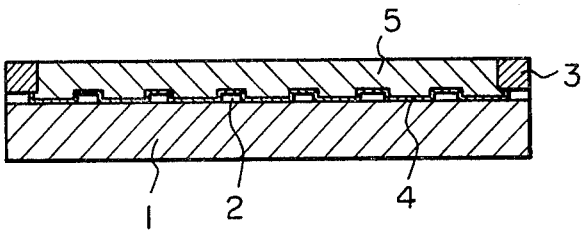
FIG. 1 is a vertical sectional view of an anode coated with β-lead dioxide on one side of the substrate according to this invention.
Figure 2:
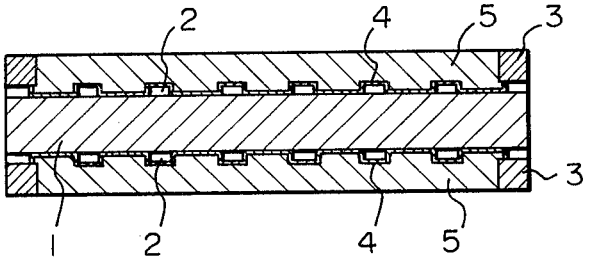
FIG. 2 is a vertical sectional view of an anode coated with β-lead dioxide on both sides of the substrate according to this invention.

This invention relates to an anode coated with β-lead dioxide which comprises five components as illustrated in FIG. 1, that is, a titanium substrate (1), titanium expanded metal (2), titanium reinforcing bars (3), at least one intermediate layer (4), and a β-lead dioxide coating layer (5).

Commercially available titanium may be used as the titanium substrate (1). At least one side of the surface of said titanium substrate is roughened by sandblasting or a chemical treatment. Said titanium expanded metal (2) has the following dimensions: long way of the diamond (LWD) in the range of from about 0.5 mm to about 5 mm, short way of the diamond (SWD) in the range of from about 0.5 mm to about 2.5 mm, a strand width (W) in the range of from about 0.1 mm to about 1 mm, and a thickness (T) of the titanium expanded metal in the range of from about 0.05 mm to about 0.6 mm. One or more of said titanium expanded metal plates (2) is laid flat on and fitted closely to said titanium substrate (1), and then spot-welded to the substrate at regular intervals. Said titanium reinforcing bars (3) are set on the peripheries of said titanium expanded metal (2), and spot-welded to both titanium substrate (1) and the titanium expanded metal (2). Said intermediate layer (4) which may consist of a single layer or plural layers is applied both on the degreased and chemical treated titanium expanded metal and the titanium substrate. β-lead dioxide coating layer (5) is built on said intermediate layer (4) by anodic electrodeposition from a lead nitrate bath.

Any commercially available titanium in the form of a plate or a cylinder of any size and thickness may be used as a substrate.

Figure 3:
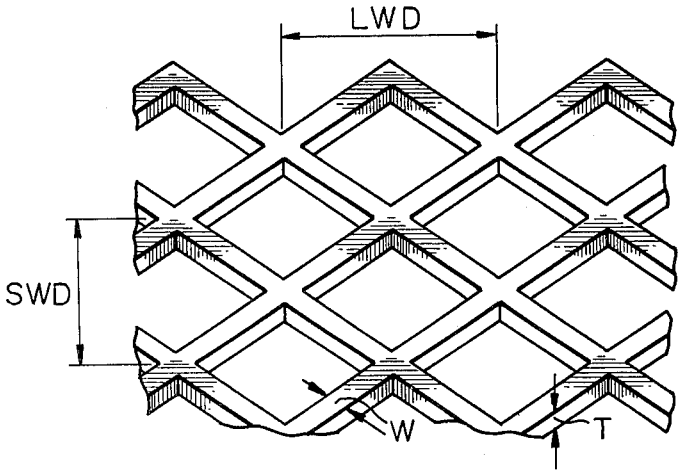
FIG. 3 is a diagram to give definitions of the terms LWD, SWD, W and T of expanded metal as used in this specification.

Said titanium expanded metal is reshaped to improve its evenness for better adhesion to the titanium substrate, and then laid on and fitted closely to the substrate, and is partly welded to the substrate by spot or seam welding. The space between weld spots or lines may vary according to the size of the anode to be manufactured and to the degree of adhesion of the titanium expanded metals to the titanium substrate desired, but mainly lies in the range of from about 10 mm to about 200 mm. There are certain ranges in preferable dimensions of said expanded metal to be used in the anode of this invention. When expressed by the terms defined in FIG. 3, the long way of the diamond (LWD) is preferably in the range of from about 0.5 mm to about 5 mm, and the short way of the diamond (SWD) is suitably in the range of from about 0.5 mm to about 2.5 mm. If LWD and SWD are greater than the preferred values given above, the surface of the anode is apt to become uneven. Furthermore, if LWD and SWD are smaller than the suitable ranges, they may result in rough surfaces and lack of adhesion of β-lead dioxide coating layer to the titanium substrate. The strand width (W) is preferably in the range of from about 0.1 mm to about 1 mm. A strand width below about 0.1 mm will be insufficient to provide effective strengthening of the coating layer, and if the strand width is larger than about 1 mm, the surface of the anode is apt to become rough. Furthermore, the thickness (T) of titanium expanded metal can be selected from the range of from about 0.05 mmm to about 0.6 mm for the same reason as the preferred range of the strand width. A titanium screen may be used instead of the expanded metal. In this case, it is preferable to use a titanium screen in the range of from about 24 mesh to about 250 mesh.

Titanium reinforcing bars are set on the peripheries of the titanium expanded metal which is partly welded to the titanium substrate. Then the titanium reinforcing bars are firmly welded to the titanium expanded metal and the titanium substrate. Owing to the reinforcing effect of the titanium reinforcing bars, the titanium expanded metal can be brought into intimate contact with titanium substrate to provide excellent adhesion of the β-lead dioxide coating layer. In fact, shock resistance and mechanical strength are greatly improved in this way, and the coating layer, particularly the edges, is protected from detaching from the substrate. The width of such reinforcing bars is preferably chosen in the range of from about 3 mm to about 15 mm. Reinforcing bars less than about 3 mm in width will be insufficient to strengthen the β-lead dioxide coating layer, and bars wider than about 15 mm will reduce the working area of the anode. The preferred thickness of the titanium reinforcing bars is in the range of from about 1 mm to about 6 mm. If it is less than about 1 mm, the strengthening effect is inadequate. On the other hand, if the titanium reinforcing bars are more than about 6 mm thick, the β-lead dioxide coating layer will come up to the same level as the reinforcing bars and this may cause cracks in the coating layer and unevenness of the anode surface. The reinforcing bars may be firmly joined to the titanium substrate and to the titanium expanded metals with through-bolts (not shown). If a very large anode is to be manufactured, in addition to the peripheries, the reinforcing bars should be placed over the entire surface of the expanded metal in a lattice pattern.

The intermediate layer to be provided in the anode of this invention is coated on the surface of the titanium substrate and of the titanium expanded metal in order to prevent oxidation of titanium with β-lead dioxide. At least one of the intermediate layers consists either of an alloy or an oxide of platinum group metals. The alloy of platinum group metals that forms said inermediate layer is selected from the group consisting of Pt-Ir, Pt-Rh, and Ir-Rh; and the oxide platinum group metal that forms said intermediate layer is selected from group consisting of $IrO_2$, $RuO_2$, and oxide of platinum. The intermediate layer may be formed on the titanium expanded metal and the titanium substrate by electroplating or by thermal decomposition of a solution of organic compounds of platinum group metals which has been applied to them. According to this procedure, the thickness of the intermediate layer can be adjusted to any desired level selected within the range of from about 0.2 to about 1.0μ.

The β-lead dioxide coating layer is anodically electrodeposited on the intermediate layer which is coated on the titanium substrate and the titanium expanded metal. The electrolyte for electrodeposition consists of lead salts such as lead nitrate, lead sulfamate, and lead acetate, and copper salts such as copper nitrate. The electrodeposition is carried out under the following conditions: concentration of lead in the electrolyte about 100–210 g/l, concentration of copper about 4–20 g/l, temperature of the electrolyte about 60°–80° C., pH of about 3.5–4.5, anodic current density about of 1–5 $A/dm^2$, with the cathode being made of stainless steel. Prior to the electrodeposition, the surface of the titanium reinforcing bars is covered with insulating tape in order to avoid any electrodeposition of β-lead dioxide on the bars which are not required to be coated. The pH value is controlled to be between about 3.5–4.5 by the addition of lead monoxide, lead carbonate or lead hydroxide. It is not advisable to deviate from the suitable electrodepositing conditions specified above, because if this is done, the electrodeposited layer obtained is apt to become lumpy and rough, and furthermore, such deviations may cause increases in internal stress which may bring about detachment and cracking of the β-lead dioxide coating layer. The height of the β-lead dioxide coating layer can be brought to the same level as that of the titanium reinforcing bars by controlling the duration of electrodeposition. The anode coated with β-lead dioxide which is made in this way is very smooth.

An anode coated with β-lead dioxide in this invention is quite suitable for the production of chlorates, perchlorates, and periodates, and furthermore, it is also useful as an anode in electroplating and in electrolytic treatment of waste water.

The β-lead dioxide coating layer in accordance with this invention totally covers the titanium expanded metal and closely fills all the crevices between the titanium substrate and the titanium expanded metal. By virtue of such a structure, it is now possible to prepare planar anodes coated with β-lead dioxide possessing mechanical strength and workability equivalent to a commercially available anode such as DSA in large sizes. Furthermore, this permits excellent dimensional stability and the manufacture of anodes in any size and shape. The dimensional stability permits narrowing the distance between the electrodes, which lowers cell voltages. The anode of this invention withstands extended use under an ordinary operation, and hence will prove very valuable as an industrial anode material.

The embodiment of this invention will be further explained in detail by the Examples and the Comparative Examples described hereunder.

EXAMPLE 1

Both sides of the titanium substrate surface (50×120 mm, 3 mm thick) were roughened by sandblast treatment. A titanium expanded metal (LWD 2 mm, SWD 1 mm, thickness 0.12 mm, and strand width 0.18 mm) was tightly placed on the substrate, and spot-welded onto the titanium substrate at a regular intervals of 25 mm. Titanium reinforcing bars (6 mm width , 2 mm thick) were set on the peripheries of the titanium expanded metal, and were firmly spot-welded to both the titanium expanded metal and the titanium substrate. This titanium substrate on which both the titanium expanded metal and the titanium reinforcing bars are welded was washed with trichloroethylene, and then degreased by 3 hours of immersion in a sodium hydroxide solution at about 80° C. Then the titanium substrate on which both the titanium expanded metal and the titanium reinforcing bars are welded was immersed in a 5 percent hydrofluoric acid solution, and then washed with water. A true solution which comprises 3 parts by weight of platinum chloride, 1 part by weight of iridium chloride and 36 parts by weight of isopropyl alcohol was applied to both the titanium expanded metal and the titanium substrate. After drying, the titanium substrate on which both the titanium expanded metal and the titanium reinforcing bars are welded was heated in an electric oven at 500° C., and was coated with a intermediate layer which consisted of Pt-Ir alloy (0.7μ thick). A β-lead dioxide coating layer was anodically electrodeposited on this intermediate layer under the conditions described hereunder.

Electrodepositing Conditions

Anode: the titanium substrate
Cathodes: stainless steel
Electrolyte: lead nitrate (200 g/l as lead) and copper nitrate (6.5 g/l as copper)
Anodic current density: 2.5 A/dm$^2$
Duration of electrodeposition: 20 hours
Temperature of electrolyte: 65° C.
pH of electrodeposition: 4.2–4.5

As a result of this electrodepositing, a β-lead dioxide coating layer 2 mm thick was formed, and its thickness was built up to the same level as that of the titanium reinforcing bars. The surface of this anode did not have any lumps or projections and had excellent flatness.

Comparative Example 1

To know the adhesion between the titanium substrate and the β-lead dioxide coating layer, a tape test was conducted with the two anodes: (1) an anode prepared as in Example 1, (2) an anode prepared as in Example 1, but no titanium expanded metal nor titanium reinforcing bars were welded onto the substrate. The tape test was conducted as follows. An adhesive tape was stuck to the surface of an anode and pressed with a roll, and then rapidly peeled off the surface of the anode. Observations of the respective anodes after tape test gave the results listed in Table 1.

TABLE 1

| Anode | Anode surface after tape test |
|---|---|
| Anode of Example 1 | No change was observed |
| Anode prepared as in Example 1, but no titanium expanded metal nor titanium reinforcing bars were welded onto the substrate | All the β-lead dioxide layer came off from the titanium substrate |

EXAMPLE 2

An anode coated with β-lead dioxide prepared as in Example 1 was used for electrolytic production of perchlorates under the following conditions.

Electrolytic condition

Anode: an anode coated with β-lead dioxide prepared as in Example 1
Cathodes: stainless steel, 50×130 mm and 3 mm thick
Electrolyte: $NaClO_3$ 500 g/l, NaF 2 g/l
Distance between both electrodes: 5 mm A distance between electrodes of 15–30 mm was indispensable for the traditional β-lead dioxide anode, but with the anode prepared as in Example 1 a distance of only 5 mm is enough. This resulted in a decrease of cell voltage by 0.2–0.5 v, and reduced the energy consumption by 5–10 percent. This electrolysis was continued for about six months or longer under conventional conditions. There were no changes in the anode such as separation of the β-lead dioxide coating layer or in the condition of the anode surface.

EXAMPLE 3

In order to know the durability of an anode prepared according to Example 1, it was used in the electroplating of Sn-Zn alloy under the following conditions.

Electroplating condition

Anode: an anode coated with β-lead dioxide prepared as in Example 1
Cathode: mild steel
DA: 5 A/dm$^2$
Temperature of electrolyte: 60° C.
Electrolyte: ordinary stannate-cyanate bath If the conventional Sn-Zn alloy anode is used, the anode should be replaced at a proper interval on account of anodic dissolution. But, according to the result of this electroplating test, the anode prepared as in Example 1 lasted for a year or longer. As is evident from the foregoing description, we have found the advantage of not making frequent anode replacements. It was found that the current efficiency of electroplating was about 90 percent, and the tin content in the alloy was about 80 percent.

What is claimed is:

1. An anode coated with β-lead dioxide which comprises:

(a) a titanium substrate having opposed sides;

(b) titanium expanded metal which is laid on and fits closely to at least one of said opposed sides of said titanium substrate and is at least partially welded thereto, said titanium expanded metal having the following dimensions: an LWD in the range of from about 0.5 mm to about 5 mm, an SWD in the range of from about 0.5 mm to about 2.5 mm, a strand width in the range of from about 0.1 mm to about 1 mm, and a titanium thickness in the range of from about 0.05 mm to about 0.6 mm;

(c) titanium reinforcing bars which are set on the peripheries of said titanium expanded metal and are at least partially welded to both said titanium expanded metal and said titanium substrate;

(d) at least one intermediate layer on said titanium substrate and said titanium expanded metal, said intermediate layer being selected from the group consisting of an alloy and an oxide of platinum group metals; and (e) a $\beta$-lead dioxide coating layer on said intermediate layer.

2. The anode coated with $\beta$-lead dioxide according to claim 1, wherein said titanium reinforcing bars have the following dimensions: a width in the range of from about 3 to about 15 mm and a thickness in the range of from about 1 mm to about 6 mm.

3. The anode coated with $\beta$-lead dioxide according to claim 1, wherein the alloy of the platinum group metals that forms said intermediate layer is selected from the group consisting of Pt-Ir, Pt-Rh, and Ir-Rh; and the oxide of the platinum group metals that forms said intermediate layer is selected from the group consisting of $IrO_2$, $RuO_2$, and oxides of platinum; and the thickness of said intermediate layer being in the range of from about $0.2\mu$ to about $1\mu$.

4. The anode coated with $\beta$-lead dioxide according to claim 1, wherein said titanium reinforcing bars, in addition to the peripheries, are placed over the entire surface of the expanded metal in a lattice pattern, and then are welded to both said titanium expanded metal and said titanium substrate.

5. The anode coated with $\beta$-lead dioxide according to claim 1, wherein said intermediate layer is Pt-Ir.

6. The anode coated with $\beta$-lead dioxide according to claim 1, wherein said intermediate layer is $IrO_2$.

7. A method for the production of the anode set forth in claim 1 which comprises the following steps:

(a) roughening the surface of at least one side of a titanium substrate having opposed sides;

(b) placing and welding titanium expanded metal onto said titanium substrate;

(c) setting and welding titanium reinforcing bars onto both said titanium expanded metal and said titanium substrate to form an anode structure;

(d) washing said structure with an organic solvent, and degreasing by immersing in alkali metal hydroxide solution for 3 hours;

(e) immersing said structure in a hydrofluoric acid solution;

(f) covering the surface of said structure with a true solution which upon heating will form an alloy or an oxide of platinum group metals;

(g) heating said structure in an oven at a temperature of from about 450° to about 600° C. to deposit said alloy or said oxide on said structure and form an intermediate layer coating said reinforcing bars, said expanded metal and the surface of the substrate to which they are attached; and (h) electrodepositing $\beta$-lead dioxide on said intermediate layer from a lead nitrate bath.

8. The method according to claim 7, wherein said welding is seam welding.

9. The method according to claim 7, wherein said true solution comprises 3 parts by weight of platinum chloride, 1 part by weight of iridium chloride and 36 parts by weight of isopropyl alcohol.

10. The method according to claim 7, wherein the heating is in an electric oven at a temperature of about 500° C.

11. The method according to claim 7, wherein said intermediate layer is Pt-Ir.

12. The method according to claim 7, wherein said intermediate layer is $IrO_2$.

13. The method according to claim 7, wherein said welding is spot welding.

* * * * *